US007316758B2

(12) United States Patent
Armstrong

(10) Patent No.: US 7,316,758 B2
(45) Date of Patent: Jan. 8, 2008

(54) METHOD OF MANUFACTURING SCREEN ASSEMBLY

(75) Inventor: Laurence P. Armstrong, Weyerhaeuser, WI (US)

(73) Assignee: FreshAir Screen Technology, LLC, Weyerhaeuser, WI (US)

( * ) Notice: Subject to any disclaimer, the term of this patent is extended or adjusted under 35 U.S.C. 154(b) by 631 days.

(21) Appl. No.: 10/825,525

(22) Filed: Apr. 15, 2004

(65) Prior Publication Data

US 2005/0006038 A1 Jan. 13, 2005

Related U.S. Application Data

(60) Provisional application No. 60/492,698, filed on Aug. 6, 2003, provisional application No. 60/485,579, filed on Jul. 9, 2003.

(51) Int. Cl.
*A47G 5/00* (2006.01)
*E06B 3/30* (2006.01)

(52) U.S. Cl. ..... 156/213; 156/476; 156/478; 156/439; 140/109; 160/371

(58) Field of Classification Search ..... 160/371; 140/109

See application file for complete search history.

(56) References Cited

U.S. PATENT DOCUMENTS 2,695,445 A * 11/1954 Johnson et al. ..... 29/417
4,843,775 A 7/1989 Armstrong et al.
6,643,988 B1 11/2003 Armstrong et al.

* cited by examiner

*Primary Examiner*—Richard Crispino
*Assistant Examiner*—Barbara J Musser
(74) *Attorney, Agent, or Firm*—Carlson, Gaskey & Olds

(57) ABSTRACT

A frame for a window screen assembly is provided that uses corner locks to secure the rails and stiles. Interlocking features provided by the corner locks are used to secure the corner locks to the rails and stiles. A method of securing screens to different sized frames using a three-stage operation is disclosed. Adhesive and a movable flange are used to secure the screen to the frame in one disclosed embodiment.

9 Claims, 14 Drawing Sheets

METHOD OF MANUFACTURING SCREEN ASSEMBLY

This application claims priority to U.S. Provisional Patent Application Nos. 60/485,579 and 60/492,698, respectively filed on Jul. 9, 2003 and Aug. 6, 2003.

BACKGROUND OF THE INVENTION

This invention relates to a screen assembly and method of manufacturing the same, and more particularly, the invention relates to a window screen assembly with an aesthetically desirable frame and a method for installing a screen onto the frame.

Prior art window screen frames have utilized a configuration in which the corner of the frame where the rails meet the stiles provide a flush appearance, which is considered by the industry to be aesthetically desirable. The prior art achieves this desired corner appearance by bending, notching, and slotting various portions of the rails and stiles so that they slidingly engage with one another at the corners. However, the prior art configurations result in an unstable joint in which the rails and stiles are permitted to move undesirably relative to one another.

The rails and stiles include flange portions having channels that receive the edges of the screen. The edges of the screen are held in the channels by splines that are installed by hand during the manufacturing process. The screen assemblies are assembled one at a time by hand, and as a result, installation of the screen using prior art methods is very costly and labor intensive resulting in a screen assembly that is costly to the window manufacturer.

Therefore, what is needed is an improved frame that provides a flush corner appearance while having desired stability between the rails and stiles. Moreover, an improved method of installing the screen onto the frame is desired. Furthermore, an apparatus and method of retaining the screen assembly within the window frame and securing the assembly against buffeting winds is also desirable.

SUMMARY OF THE INVENTION

The inventive frame includes a rail and a stile transverse to one another. The rail and stile each include tubular portions and flange portions extending from the tubular portions. The flange portions receive edges of the screen. A corner lock having first and second transverse legs secure the end portions of the rail and stile. Interlocking features provided by the corner lock are used to secure the rail and stile to the corner lock. For example, clips, latches, latch retainers, and protrusions provided by the rail and/or stile may be used to secure the rail and stile to the corner lock. In this manner, the rail and stile are secured to one another providing improved stability while enabling a flush, aesthetically desirable appearance where the rail meets the stile.

The invention also sets forth rails and/or stiles providing a flange portion with a movable flange to mechanically secure the edges of the screen to the frame without the use of a spline. The movable flange mechanically retains the screen, and adhesive may additionally be used within the channel to secure the screen to the frame.

The present invention also sets forth a method of installing screens onto frames. A first screen is secured to a top rail of a first frame at a first stage. The first frame is transferred to a second stage and a second frame is received at the first stage. The first screen is simultaneously secured to the bottom rail of the first frame while a second screen is secured to the top rail of the second frame. The first frame is transferred to a third stage, the second frame is transferred to the second stage, and a third frame is transferred to the first stage. The first screen is simultaneously secured to the stiles of the first frame.

Accordingly, the present invention provides an improved frame having a flush corner appearance while providing desired stability between the rails and stiles. Moreover, the invention provides an improved method of installing the screen onto the frame.

DETAILED DESCRIPTION OF THE PREFERRED EMBODIMENT

Figure 1:
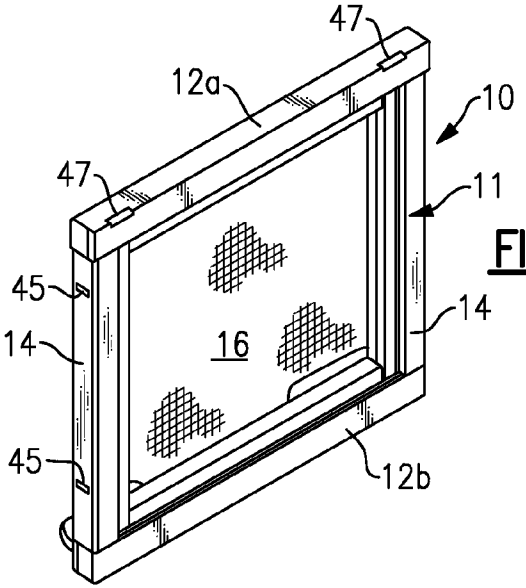
FIG. 1 is a perspective view of an inventive screen assembly suitable for window glider applications.
Figure 2:
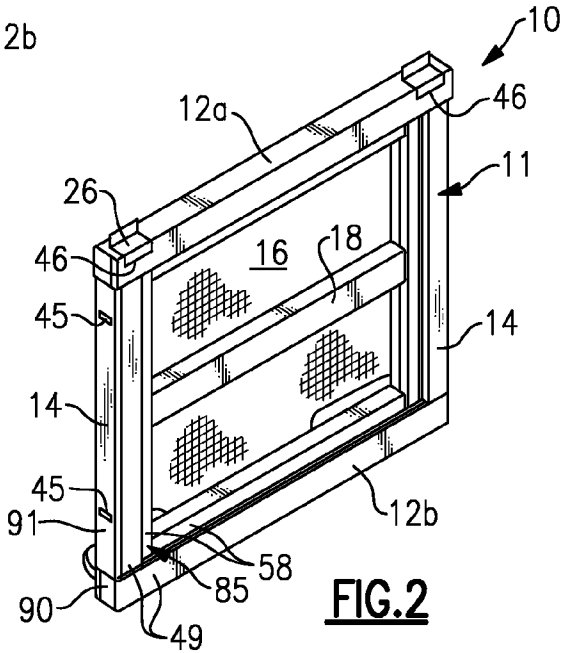
FIG. 2 is a perspective view of the inventive screen assembly suitable for double-hung window applications.

FIG. 1 depicts one configuration of an inventive screen assembly 10. The assembly 10 includes a frame 11 having frame members such as top rail 12A and bottom rail 12B secured by stiles 14. A screen 16 is attached to the frame 11 at its edges. The configuration as shown in FIG. 1 is suitable for such applications as glider-type windows. The configuration shown in FIG. 2 is similar to that shown in FIG. 1 with the addition of an intermediate member 18 secured between the stiles 14 and is suitable for double-hung window applications. Outer faces 49 of the rails 12A and 12B and stiles 14 are generally flush with one another, preferably on both sides of the frame 11, providing an aesthetically pleasing flush corner appearance.

It should be understood that the invention features set forth in the present application are applicable to the furniture industry, for example, for use in manufacturing office furniture panels or dividers.

Figure 3:
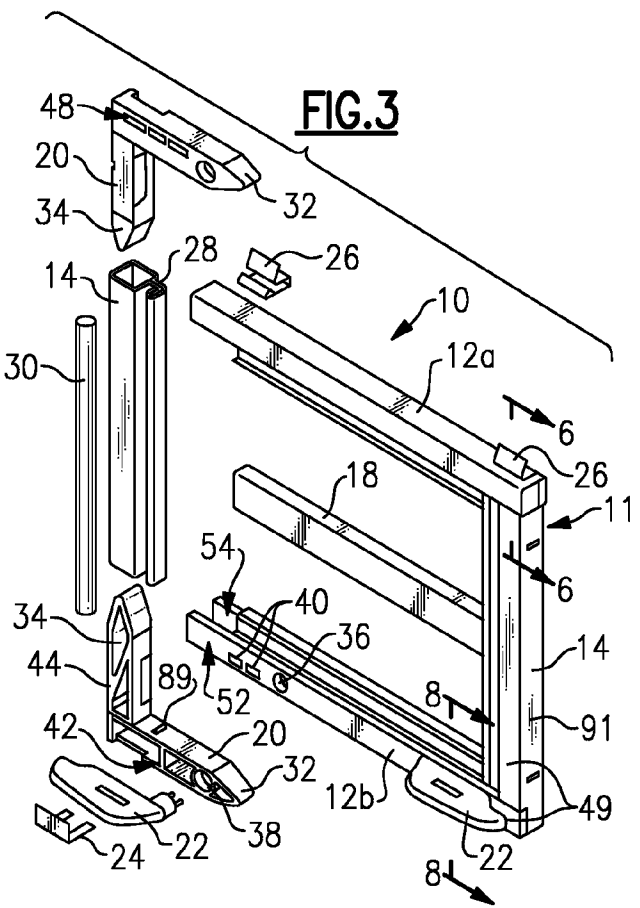
FIG. 3 is an exploded perspective view of the inventive screen assembly shown in FIG. 2.

An exploded view of the assembly 10 depicted in FIG. 2 is shown in FIG. 3. Corner locks 20 are used at each of the corners of the frame 11 to secure the rails 12A and 12B to the stiles 14. The corner locks 20 are interchangeable between the four corners of the frame 11. A latch 22 is supported on the bottom rail 12B at each of the corners to secure the bottom of the assembly 10 to the window frame (not shown). A latch retainer 24 is inserted into the bottom rail 12B and corner lock 20 at each of the lower corners to secure the corner locks 20 to the bottom rail 12B. A clip 26 secures the top rail 12A to the corner locks 20 at the upper corners. The clips 26 locate the top of the assembly 10 relative to the window frame (not shown) in a desired manner.

The rails 12A and 12B and stiles 14 have channels 28 arranged around the inner periphery of the frame 11. The edges of the screen 16 are retained within the channels 28 by inserting splines 30 into the channels 28 retaining the edges of the screen 16 between the spline 30 and frame 11.

The corner locks 20 include first leg 32 received in the end portions of the rails 12A and 12B. A second leg 34 of the corner locks 20 is received in the end portions of the stiles 14. The bottom rail 12B includes apertures 36 in each of the end portions for receiving the latches 22, which cooperate with a first interlocking feature 38 provided by the corner locks 20. The bottom rail 12B also includes pairs of slots 40 at each of the end portions for receiving the latch retainer 24, which cooperates with a second interlocking feature 42 provided by each of the corner locks 20. Protrusions 45 in the stiles 14 cooperate with a third interlocking feature 44 provided by each of the corner locks 20 to secure the stiles 14 to the corner locks 20.

The top rail 12A includes a slot 46 at each of its end portions for receiving the clip 26, which cooperates with a fourth interlocking feature 48 provided by each of the corner locks 20, as shown in FIGS. 2 and 3. For some frames, for example, of the type shown in FIG. 1, there is no need to secure the top rail 12A to the upper corner locks 20 since it is sufficiently retained by the stiles 14 that are secured to the bottom rail 12B. Alternatively, protrusions 47 may be used, as shown in FIG. 1, to secure the top rail 12A to the upper corner locks 20.

"First," "second," "third," and "fourth" are merely labels used for convenience and may be used interchangeably with one another.

Figure 3A:
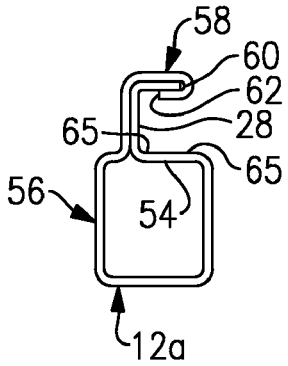
FIG. 3A is a cross-sectional view of a top rail of the present invention.
Figure 3B:
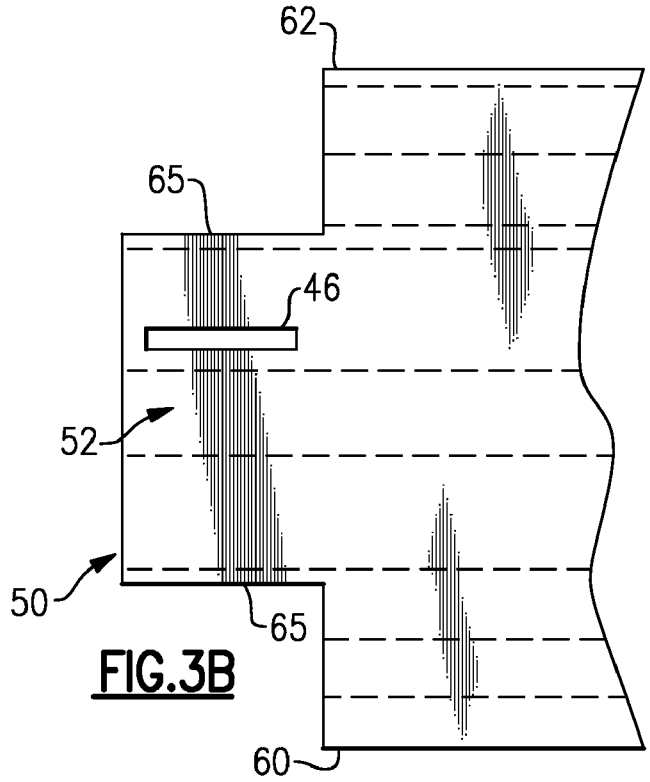
FIG. 3B is an elevational view of a blank used to form the top rail.

FIG. 3A depicts a cross-section of the top rail 12A, and FIG. 3B depicts a blank 50 used to form the top rail 12A. The top rail blank 50 includes an extension 52 at either end (only one shown) that provides an opening 54 permitting the second legs 34 to extend through the openings 54. The top rail blank 50 is deformed along the dashed lines to provide the shape of the top rail 12A shown in FIG. 3A. The slot 46 is provided on the extension 52, as shown in FIG. 3B.

The top rail 12A includes a tubular portion 56 for receiving the first legs 32 of the corner locks 20. A flange portion 58 extends from the tubular portion 56 for receiving edges of the screen 16 and the spline 30. In the embodiment shown, a second edge 62 of the top rail blank 50 is folded over the first edge 60 to provide an end of the flange portion 58 depicted in FIG. 3A.

Figure 4A:
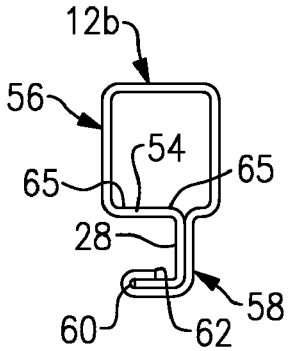
FIG. 4A is a cross-sectional view of a bottom rail of the present invention.
Figure 4B:
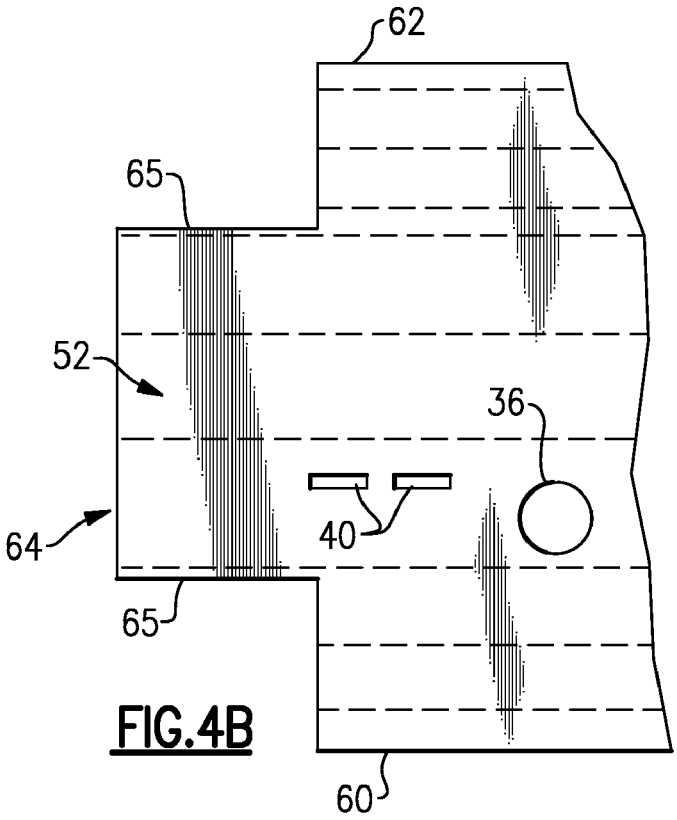
FIG. 4B is an elevational view of a blank used to form the bottom rail.

A cross-sectional view of the bottom rail 12B is shown in FIG. 4A, and a bottom rail blank 64 used in providing the bottom rail 12B is shown in FIG. 4B. The bottom rail blank 64 is formed in a similar manner to that discussed relative to top rail blank 50. The aperture 36 and slots 40 are provided inboard of the extension 52.

The extensions 52 include corner edges 65 that are received in opposing grooves 88 where the second leg 34 meets the first leg 32.

Figure 5A:
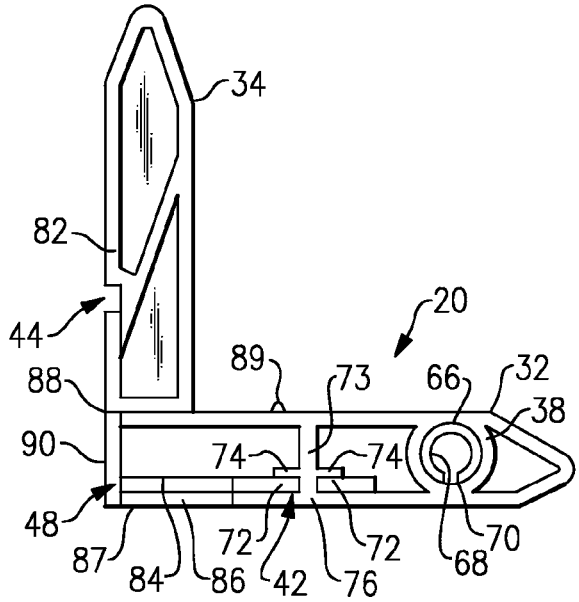
FIGS. 5A and 5B are respectively front and rear elevational views of an inventive corner lock.
Figure 5B:
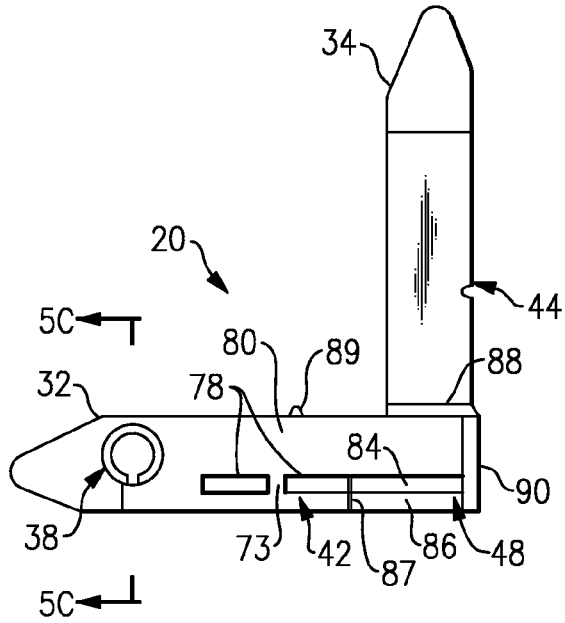
Figure 5C:
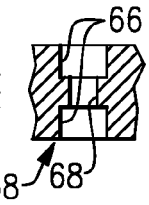
FIG. 5C is a cross-sectional view taken along line 5C-5C of FIG. 5B.

Referring to FIGS. 5A-5C, the first interlocking feature 38 is a hole provided by opposing first portions 66 having approximately equal diameters, in the example shown. A second portion 68 is arranged between the opposing first portions 66 and has a diameter that is smaller than that of the opposing first portions 66. The second portion 68 includes a keyway 70 for receiving a portion of the latch 22 in a particular orientation, which will be discussed in more detail relative to FIGS. 10A and 10B.

The second interlocking feature 42 is provided by opposing notches 72 that are provided by opposing first walls 74 separated by an intermediate wall 73. The opposing notches 72 are further defined by a second wall 76 spaced from the first wall 74. The second wall 76 provides a bottom wall 87 of the first leg 32 in the example shown. The opposing notches 72 extend to the back wall 80 providing slotted holes 78, best shown in FIG. 5B.

The third interlocking feature 44 is provided by an annular groove that extends between a front surface 82 of the second leg 34 to a back wall 80 of the corner lock 20.

Figure 6:
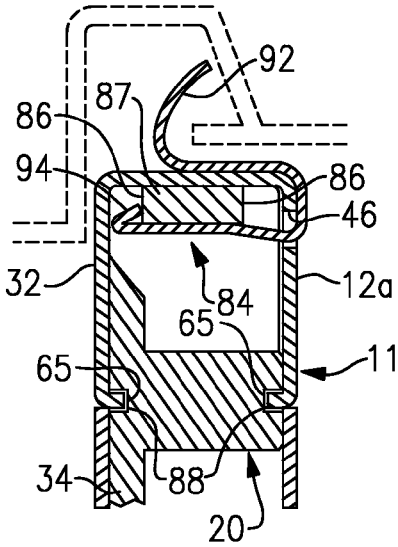
FIG. 6 is a cross-sectional view of the top rail taken along line 6-6 of FIG. 3.

The fourth interlocking feature 48 is provided by a slotted hole 84 that extends through the back wall 80. The bottom wall 87 adjacent to the slotted hole 84 includes opposing recessed surfaces 86, which are best shown in FIG. 6. If the clip 26 is not used, the protrusions 47 shown in FIG. 1 may be arranged to cooperate with at least one of the recessed surfaces 86.

An end 90 of the first leg 32 adjacent to the second leg 34 extends outwardly relative to the second leg 34 by approximately the width of the thickness of the wall of the stile 14 so that the ends of the corner locks 20 are flush with peripheral faces 91 of the stiles 14, best shown in FIG. 2. The first leg 32 includes a stop 89 that locates the corner locks 20 relative to the rails 12A and 12B. The stop 89 positions the second leg 34 at a distance from the flange portion 58 of the rails 12A and 12B creating a gap 85, shown in FIG. 2, to accommodate the flange portions 58 of the stiles 14.

Figure 7:
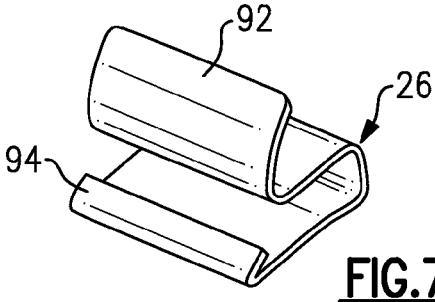
FIG. 7 is a perspective view of a clip of the present invention.

Referring to FIG. 6, the clip 26 is shown securing the top rail 12A to the corner lock 20. The clip 26, best shown in FIG. 7, includes a spring portion 92 and a hook portion 94. The spring portion 92 secures the frame 11 relative to the window frame, which is shown in phantom in FIG. 6. The hook portion 94 is inserted through the slot 46 and through the slotted hole 84 until it is seated on one of the opposing recessed surfaces 86.

Figure 9:
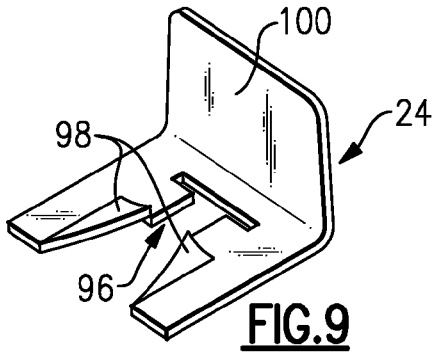
FIG. 9 is a perspective view of a latch retainer of the present invention.
Figure 8:
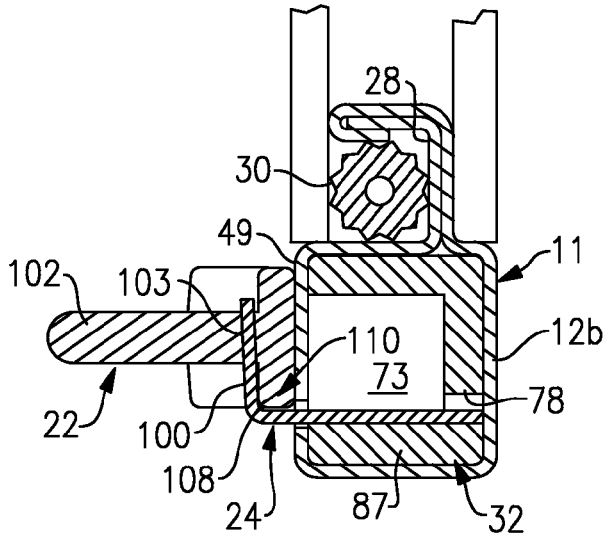
FIG. 8 is a cross-sectional view of the bottom rail of the present invention taken along 8-8 of FIG. 3.

FIG. 8 depicts the latch 22 and latch retainer 24 supported on the bottom rail 12B. The latch retainer 24, which is best shown in FIG. 9, includes an opening 96 between the space apart barbs 98. An angled portion 100 facilitates insertion of the latch retainer 24 into the bottom rail 12B and cooperates with the latch 22, as shown in FIG. 8. The barbs 98 are inserted through the slots 40 and into the opposing notches 72. The intermediate wall 73 is positioned within the opening 96. The barbs 98 bite into the spaced part first walls 74 preventing the latch retainer 24 from becoming dislodged from the corner lock 20. The ends of the barbs 98 are received within the slotted holes 78.

Figure 10B:
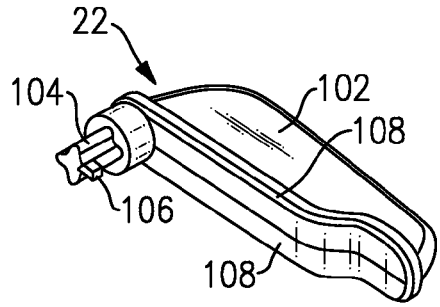
FIGS. 10A and 10B are respectively front and rear perspective views of a latch of the present invention.
Figure 10A:
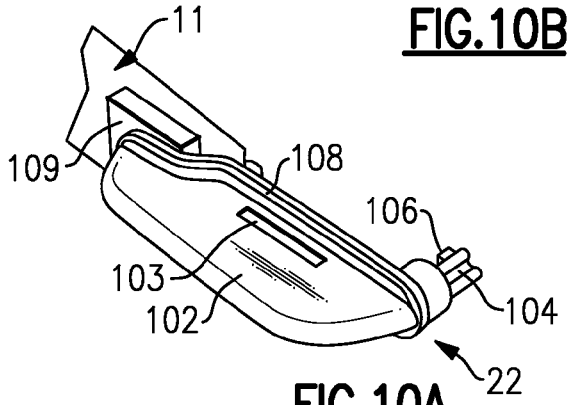

The latch 22 is shown in FIGS. 10A and 10B. Latch 22 includes a handle 102 for rotationally positioning the latch 22 in a desired manner. Latch 22 includes a protrusion 104 extending from the handle 102. The protrusion 104 is received by the first interlocking feature 38. Specifically, the protrusion 104 includes a key 106 that is rotationally positioned so that it can be slidingly received by the keyway 70 in the second portion 68. The key 106 is misaligned with the keyway 70 when the latch 22 is in a closed position, which is shown in FIG. 8. The latch 22 is rotated so that a flange 108 extending from the handle 102 is received within a pocket 110 provided between the angled portion 100 of the latch retainer 24 and the outer face 49 of the bottom rail 12B. The latch 22 secures the frame 11 to the window frame with the latch 22 in the closed position by retaining a window frame flange 109, schematically shown in FIG. 10A, between the frame 11 and a portion of the flange 108 that extends away from the frame 11. An aperture 103 in the handle 102 receives the angled portion 100 to additionally maintain the latch 22 in the closed position.

Figure 11:
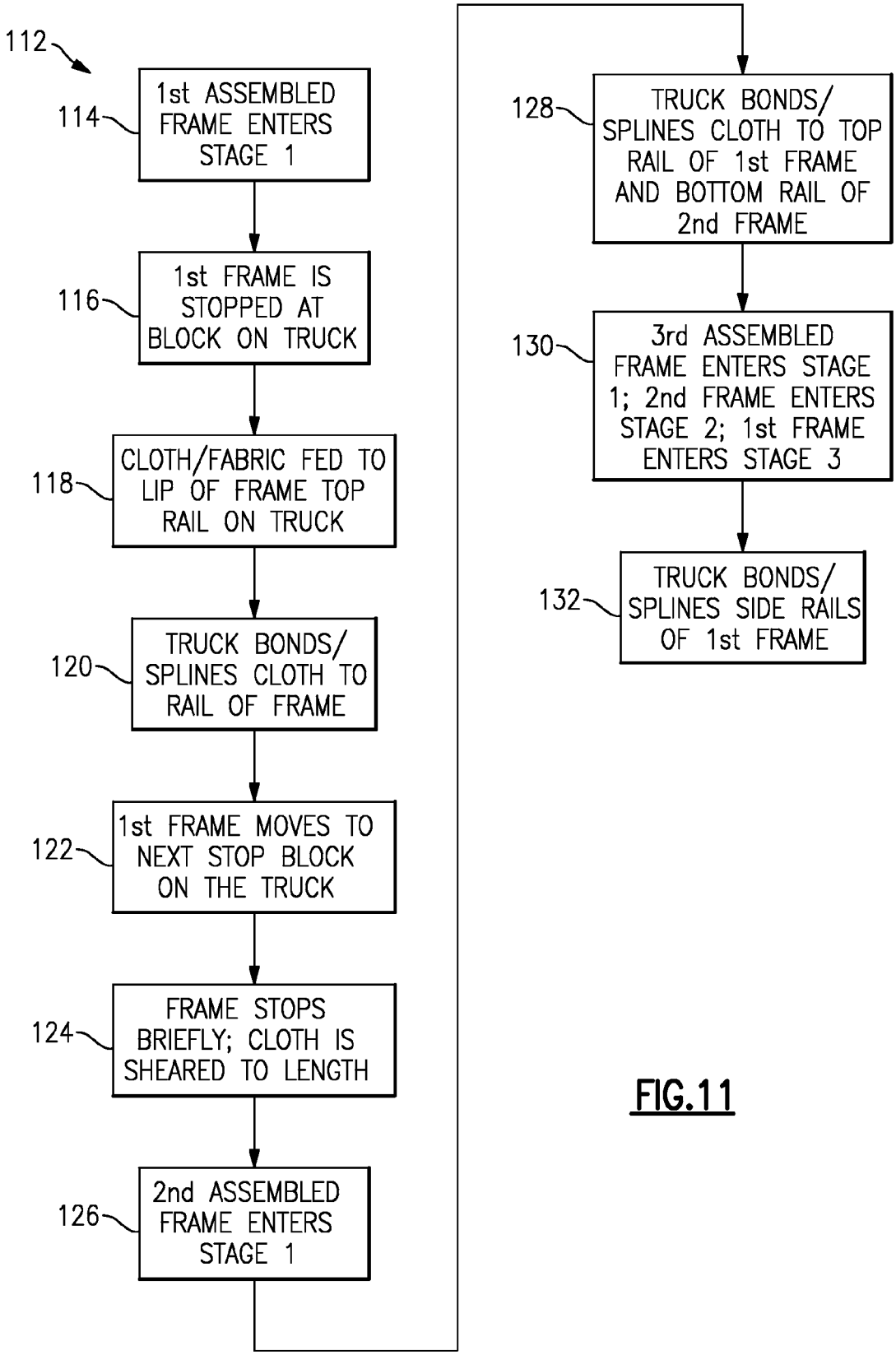
FIG. 11 is a flow chart of an inventive method of installing a screen onto the inventive frame.

The inventive screen assembly 10 can be made more cost efficient by utilizing the inventive method as schematically set forth in FIG. 11 to secure the screen 16 to the inventive frame 11. However, it should be understood that the inventive method may be used with prior art frames. The inventive method is employed by utilizing a machine 134 shown in FIGS. 12A and 12B. In one example of the embodiment, the machine 134 includes three stages having the flexibility to reposition components to accommodate frames of different size without having to manually re-fixture the machine 134 to accommodate an uninterrupted flow of frames through the machine.

The inventive method 112 begins by receiving a first assembled frame at Stage One of the machine 134, as indicated at block 114. The first frame is stopped at a stop block 152 of a truck assembly 150, as indicated at block 116. The screen cloth or fabric is fed to the top rail 12A, as indicated at block 118. The truck assembly 150 bonds or splines the screen 16 to the top rail 12A, as indicated at block 120.

The first frame moves to the next stop block on the truck assembly 150, as indicated at block 122, and the screen cloth is sheared to length, as indicated at block 124. The second assembled frame enters Stage One, as indicated at block 126. The frame entering at Stage One may be of a different size than the frame exiting Stage One and entering Stage Two. The truck assembly 150 bonds or splines the screen cloth to the top rail 12A of the second frame and the bottom rail 12B of the first frame simultaneously, as indicated at block 128. The first frame enters Stage Three, and the second frame enters Stage Two after locating and screen sharing, as indicated at block 130. A third assembled frame enters Stage One, and may be of different dimensions than both the first and second frames. Truck assemblies 177 bond or spline the stiles 14 of the first frame, indicated at block 132. The frames continue to progress through the various stages as described above.

Figure 12A:
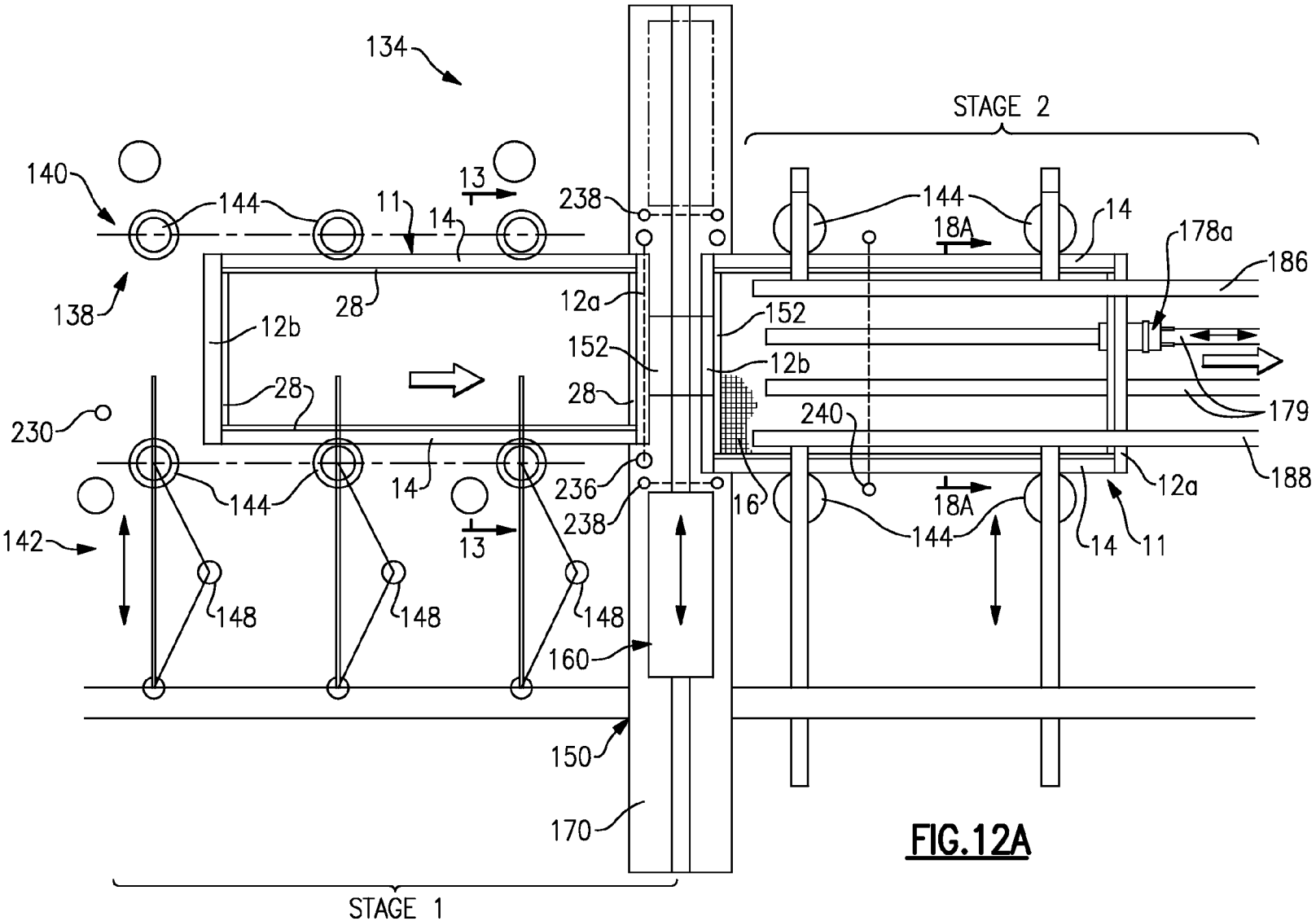
FIGS. 12A and 12B depict a machine of the present invention for installing the screen onto the inventive screen assembly frame.
Figure 13:
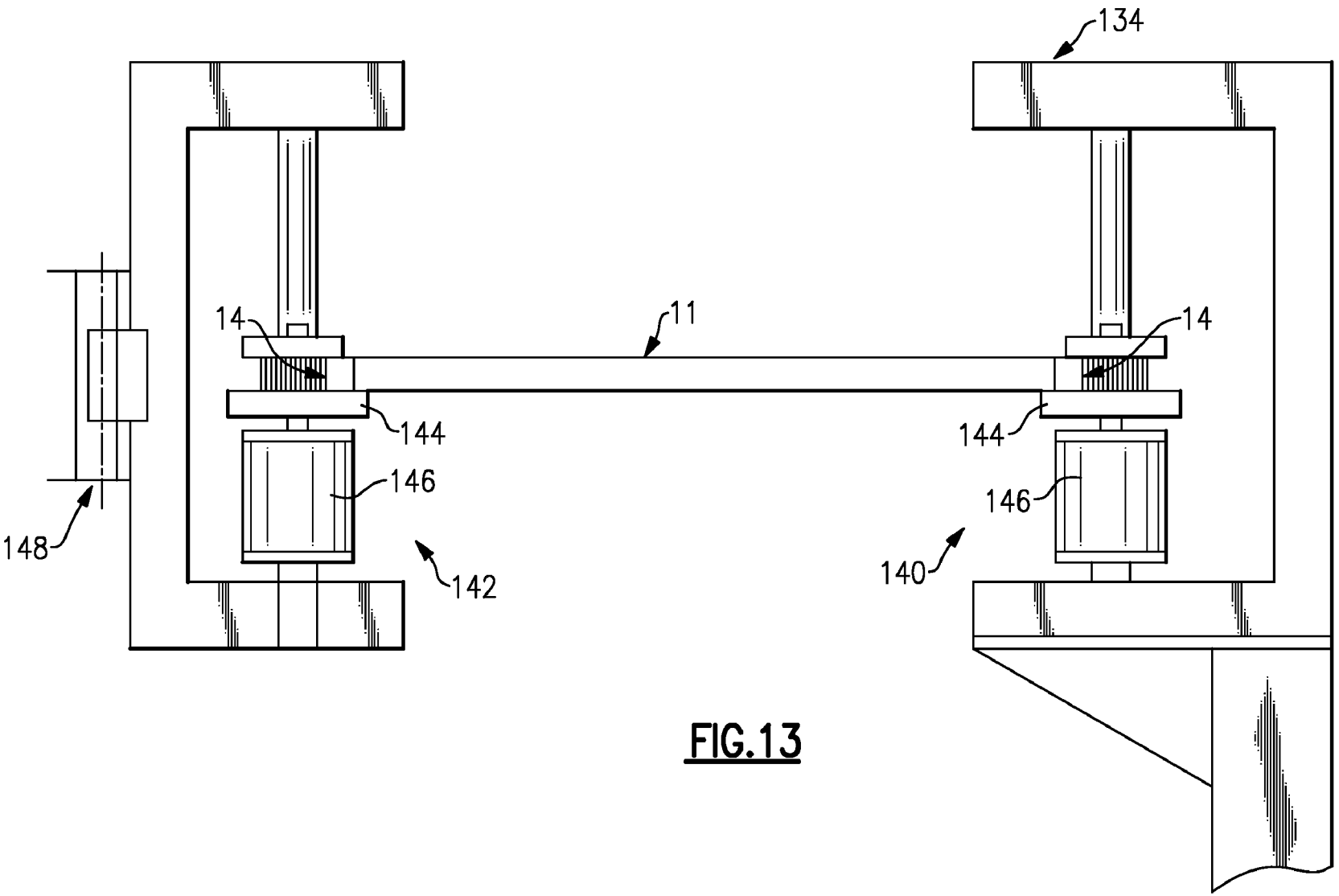
FIG. 13 is a cross-sectional view of the machine taken along line 13-13 of FIG. 12A.

A more detailed description will be made with reference to the machine 134 and its various components. The machine 134 includes a transfer mechanism 138 for carrying the various sized frames 11 throughout the stages. The transfer mechanism 138 includes a fixed transfer side 140 and an adjustable transfer side 142 opposite the fixed transfer side 140. The adjustable transfer side 142 can move closer to or farther from the fixed transfer side 140 to accommodate frames 11 of different widths. The transfer mechanism 138 includes wheels 144 driven by server motors 146, as is best shown in FIG. 13. The server motors 146 control the position of the frame 11 as they progress through the machine 134. The wheels 144 and server motors 146 on the adjustable transfer side 142 are moved to a desired position by manipulating an adjustable linkage 148, which is schematically shown in FIG. 12A.

The truck assembly 150 provides the vertically movable stop blocks 152, which locate the frames 11. The stop blocks 152 maintain a desired spacing between the frames 11 in Stage One and Stage Two to achieve a consistency in securing the screens 16 to the frames 11. The truck assembly 150 places the splines 30 within the channels 28 and cuts the spline 30 to desired lengths.

Figure 14:
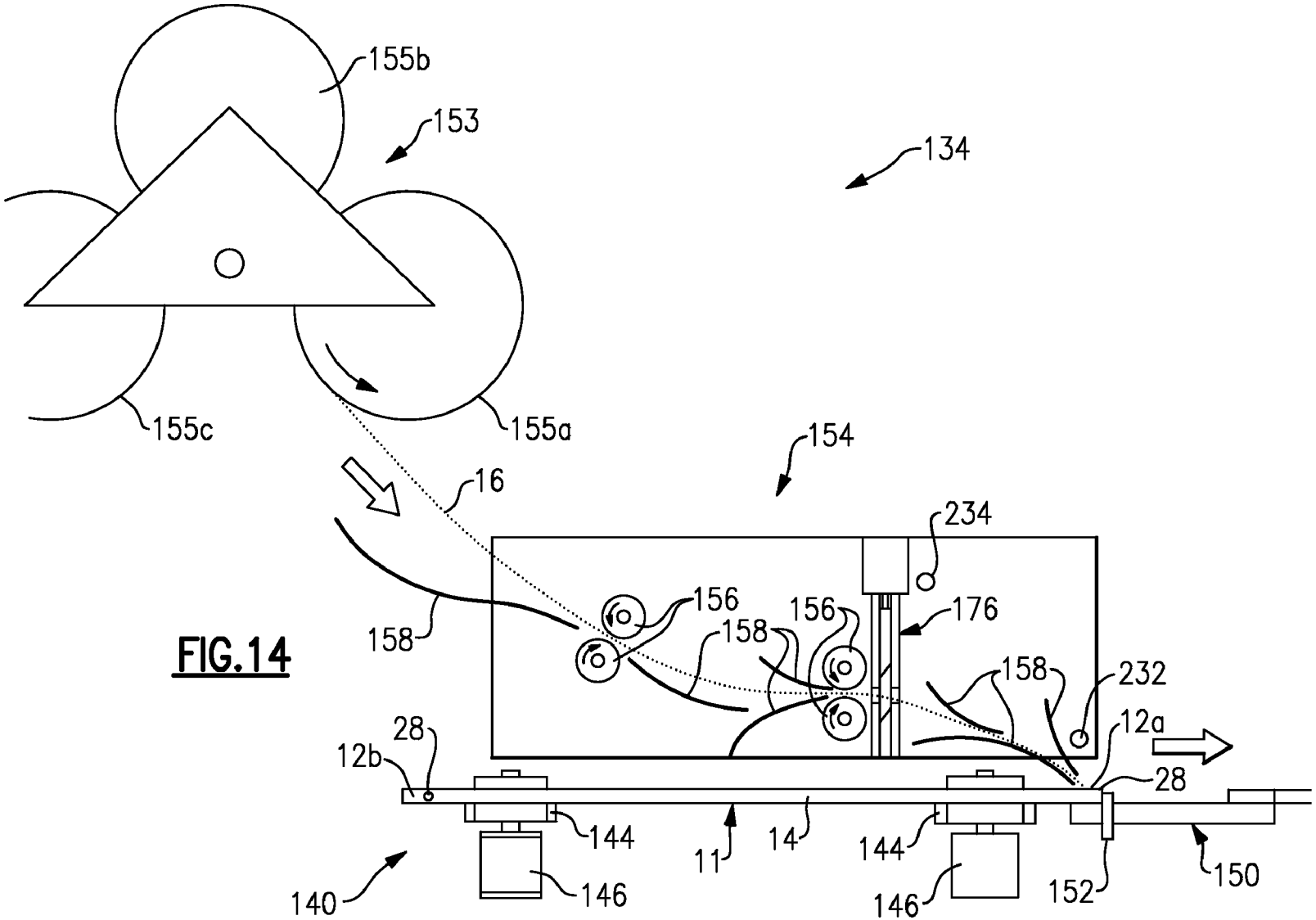
FIG. 14 is a side elevational view of a screen feeder.

A screen feeder 154 is positioned over the frame 11 in Stage One. The screen feeder 154 is not shown in FIG. 12A for clarity, but it is shown in detail in FIG. 14. The screen feeder 154 receives screen from one of the rolls of screen 155A, 155B, or 155C from a powered carousel that feeds the screen 16 into a series of rollers 156. The rolls 155A, 155B, and 155C each contain screen of different widths to accommodate various common frame widths. The term "screen" is intended to include cloth and woven fabrics. The rollers 156 and guides 158 feed the screen 16 onto the frame 11. The edge of the screen 16 is fed to the channel 28 of the top rail 12A.

Figure 15:
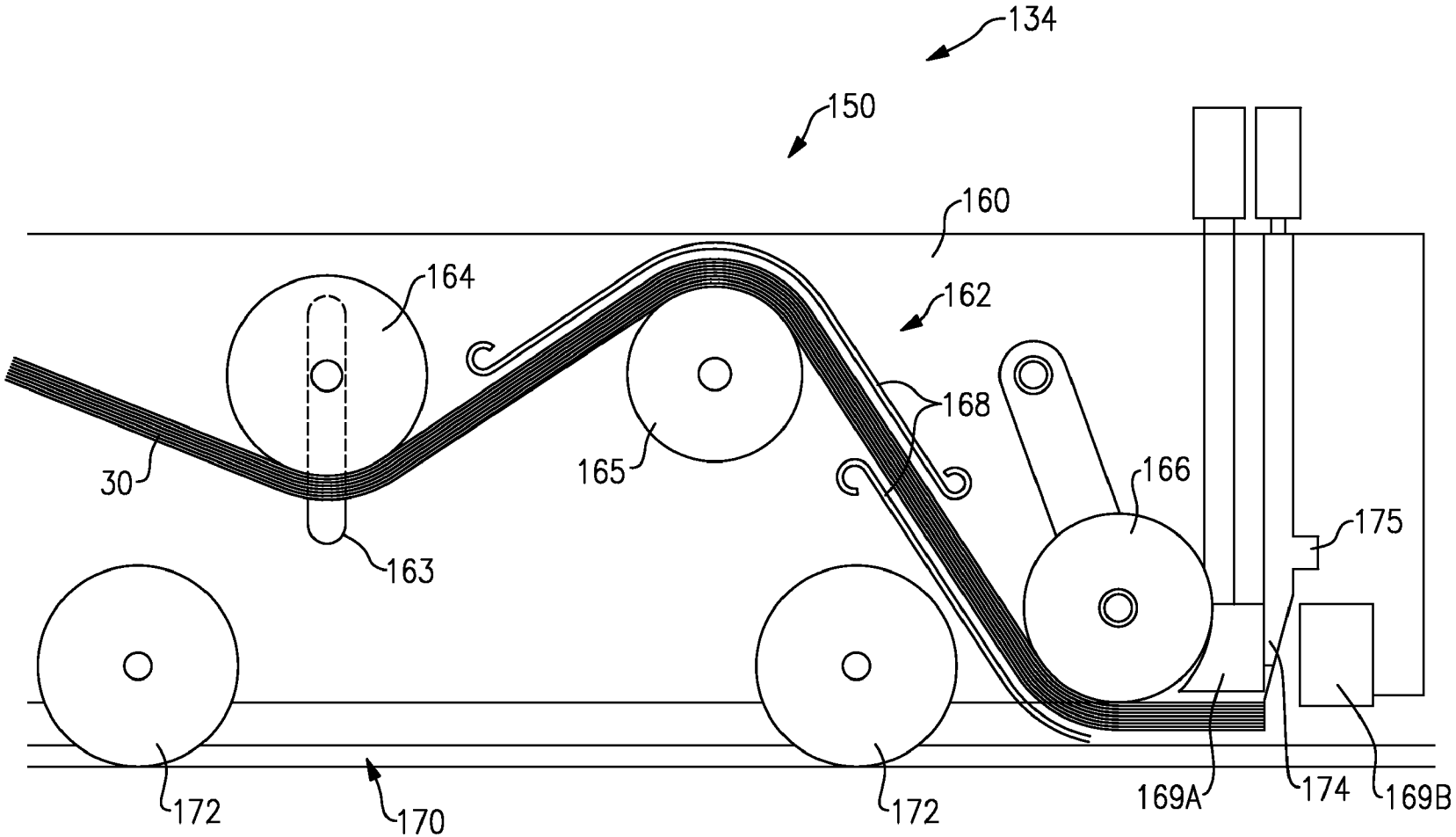
FIG. 15 is a side elevational view of a truck assembly with spline feeder shown in FIG. 12A.

The spline 30 is inserted into the channel 28 retaining the edge of the screen 16 in the top rail 12A using the truck assembly 150, which is best shown in FIG. 15. The frame 11 is advanced to Stage Two and a screen shearer 176 shears the screen 16 to the desired length for the particular frame 11.

Referring to FIG. 15, the truck assembly 150 includes a truck 160 carrying a spline feeder 162 on either side of the truck 160. The truck 160 includes wheels 172 that are supported on a track 170 and driven along the track 170 by a power guide 173. Each spline feeder 162 includes a tension roller 164 movably positioned within a slot 163 to maintain tension on the spline 30. The spline 30 travels from the tension roller 164 through a feed roller 165 to a set roller 166. Guides 168 position the spline 30 relative to the rollers 164, 165, 166 in a desired manner.

Figure 16:
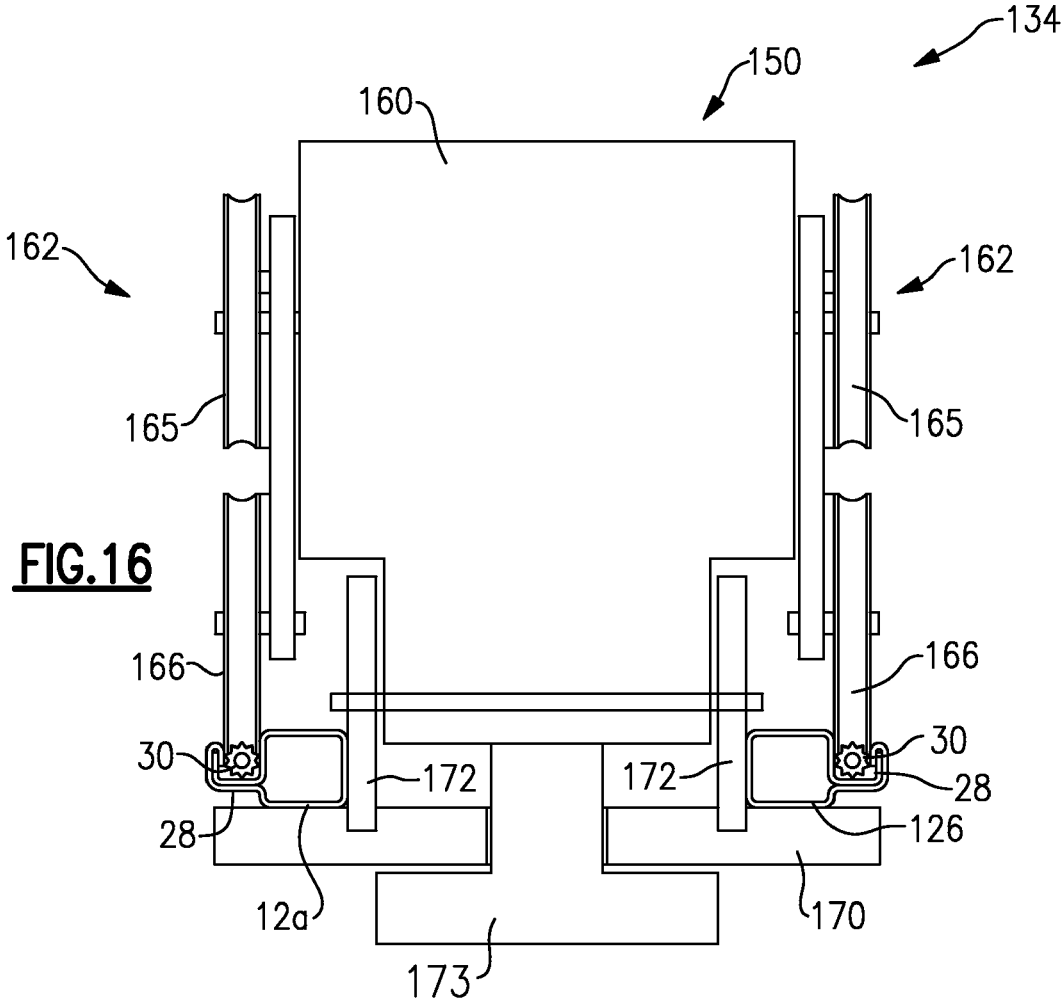
FIG. 16 is a rear elevational view of the truck assembly shown in FIG. 15.

The set roller 166 and a spline set pads 169A and 169B force the spline 30 into the channels 28. Spline set pad 169A is moved downward by an actuator to force the free end of the spline 30 into the channel 28 at a first end of one of the frame members. A spline shearer 174 cuts the spline 30 to a desired length depending upon the dimensions of the frame 11. As can be seen in FIG. 16, the truck 160 includes a spline feeder 162 on either side so that splines 30 of different lengths may be cut to accommodate frames 11 of different dimensions in Stage One and Stage Two. The spline shearer 174 is driven by a servo or pneumatic actuator to force the set pad 169B (shown in FIG. 15) downward with a flange 175 to cut the spline 30 and force the cut end of the spline 30 into the channel 28. As the spline shearer 174 cuts the spline 30 to length at a second end of the frame member.

Figure 12B:
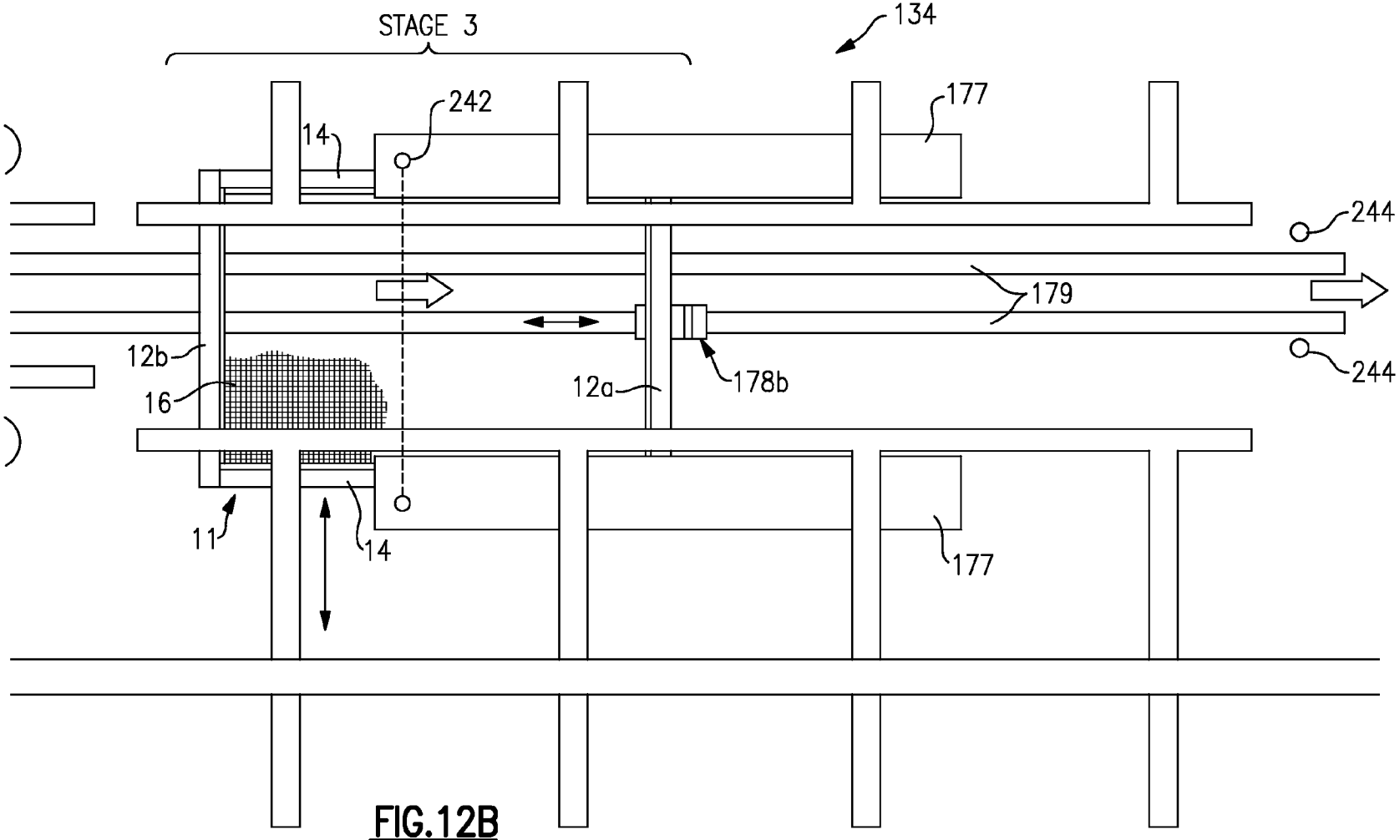
Figure 17:
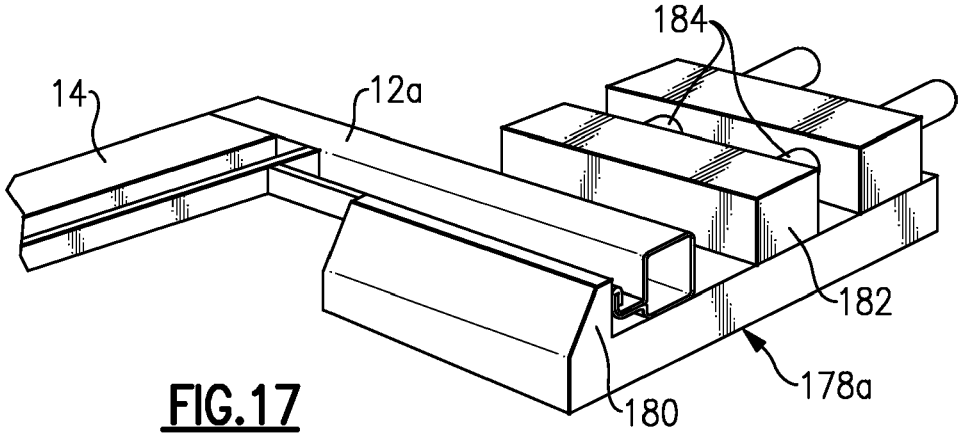
FIG. 17 is a perspective view of a clamp assembly shown in FIGS. 12A and 12B.
Figure 18B:
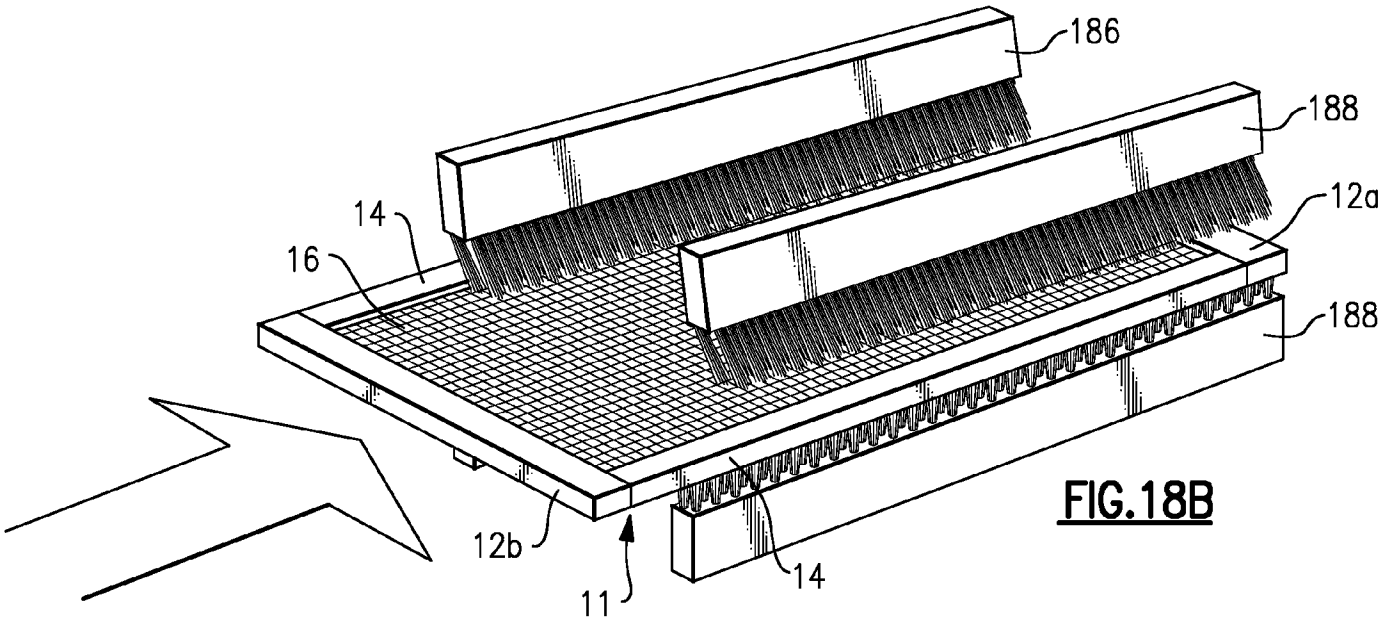
FIG. 18B is a perspective view of the bristles shown in FIG. 18A.
Figure 18A:
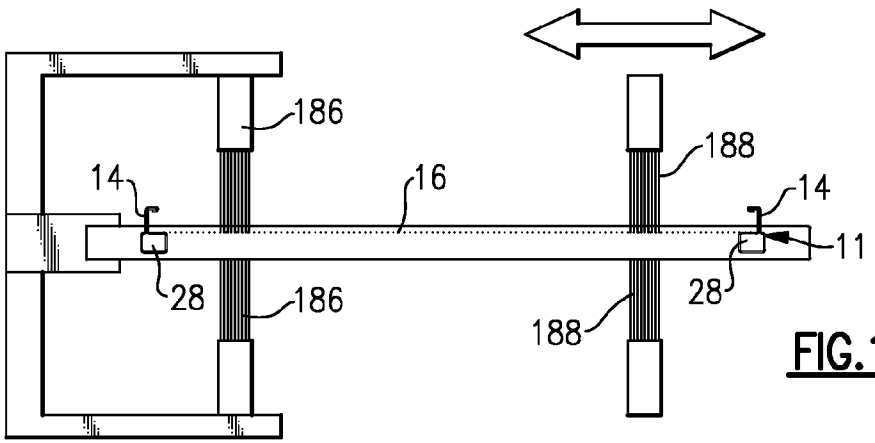
FIG. 18A is a cross-sectional view of the bristles shown in FIG. 12A.

Longitudinal trucks 177 are fixedly positioned on either side of the frame 11 in Stage Three, as shown in FIG. 12B, to place the spline 30 in the channels 28 of the stiles 14. A pair of spaced apart tracks 179 having clamps 178A and 178B are used to move the frames 11 from Stage Two to Stage Three and from Stage Three to another transfer mechanism. The clamps 178A and 178B each include a fixed jaw 180 and movable jaw 182 that opens and closes using ball screws 184 to clamp the top rail 12A between the jaws 180 and 182, as best shown in FIG. 17. The clamps 178A and 178B rotate downward so they do not collide with the frames 11 when returning to pick up a new frame subsequent to completing the screen 16 installation at Stage Three. Such systems are commercially available from companies such as Timken, Bosch, or Thompson.

Stage Two includes upper and lower fixed bristles 186 and upper and lower adjustable bristles 188 spaced from fixed bristles 186. The bristles 186 and 188 position the lateral edges of the screen 16 relative to the channels 28 and the stiles 14 as the frame 11 is moved into position by one of the clamps 178A and 178B. The adjustable bristles 188 are movable relative to the fixed bristles 186 in a similar manner to that of the fixed 140 and adjustable 142 transfer sides of the transfer mechanism 138 to accommodate frames of different sizes. The bristles 186 and 188 are soft brushes that overlap somewhat to lay the screen flat. Once the screen 16 is in the desired position, the bristles 186 and 188 extend through the mesh fabric of the screen 16 to hold the screen 16 in place.

The adjustable transfer side 142, adjustable bristles 188, and one of the truck assemblies 177 are independently adjustable from one another to accommodate frames 11 of different sizes at each of the Stages.

The machine 134 includes various sensors that interact with a controller to control the flow of frames through the Stages and make adjustments to accommodate the various screen sizes. For example, a frame sizing proximity sensor 230 senses the width of the screen 11 as it is fed into Stage One by an operator, best shown in FIG. 12A. A stop sensor 231 senses the frame 11 when it reaches the desired location within Stage One and raises the first stop block 152 to retain the frame 11.

A cloth location sensor 232 on the screen feeder 154 senses the edge of the screen relative to the top rail 12A and stops the advance of the screen until the spline 30 secures the screen 16 to the top rail 12A. A cloth dispenser sensor 234 on the screen feeder 154 senses position of the frame in Stage 2 and cuts the screen 16 to the desired length once the bottom rail 12B passes under the cloth dispenser sensor 234.

Truck activation sensors 238 on either side of the truck assembly 150 sense which side the truck 160 is on. The truck 160 may return to one side to lay the spline 30 for the next set of frames 11. However, in the case of the alternative truck assembly 196 discussed below, the truck need not return to a "home" position. A frame sensor 240 detects the presence of the frame 11 in Stage Two and prompts a clamp 178A or 178B to clamp the top rail 12A.

Truck activation sensor 242 detect the frame 11 in Stage Three to begin splining the stiles 14. A clamp position sensor 244 detects the position of the clamps 178A and 178B at the end of Stage Three so that the screen assemblies 10 may be ejected and the clamps 178A and 178B returned to a "home" position.

Figure 19:
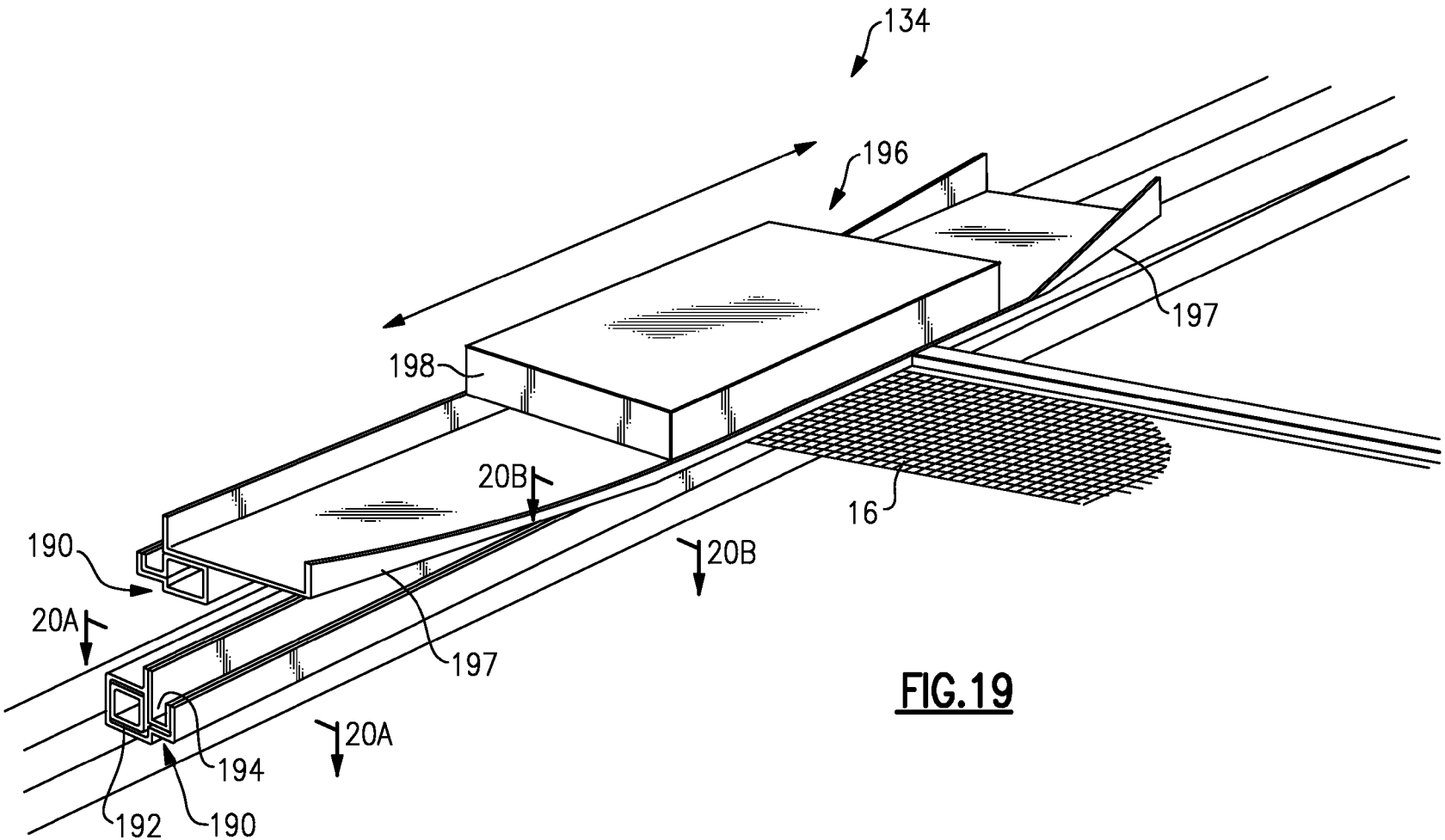
FIG. 19 is a perspective view of an alternative truck assembly used to form portions of the rails and/or stiles shown in FIGS. 20A and 20B and heat the adhesive.

An alternative truck assembly 196 is shown in FIG. 19. The truck assembly 196 is used for an alternative frame configuration 190, best shown in FIGS. 20A and 20B. The frame 190 utilizes adhesive to secure the edges of the screen 16 in the channels 194. To this end, the truck assembly 196 includes upwardly tapering surfaces 197 for deforming a portion of the frame 190. A heat source 198 is used to heat and cure an adhesive.

Figure 20B:
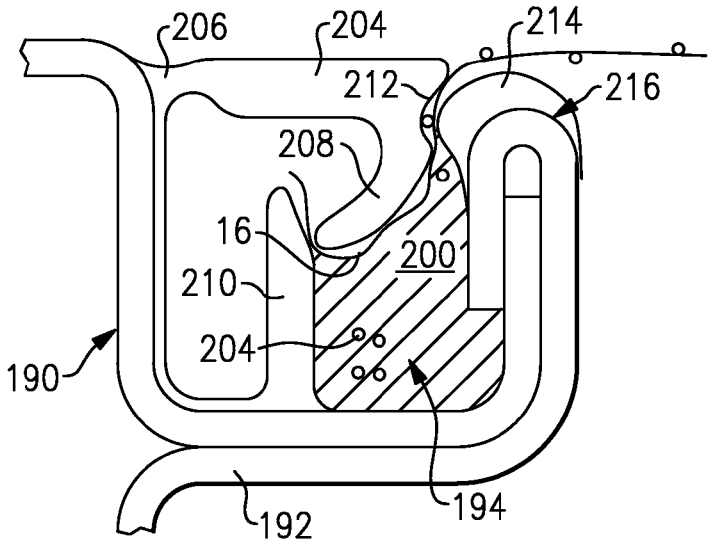
FIGS. 20A and 20B are cross-sectional views respectively taken along lines 20A-20A and 20B-20B of FIG. 19.
Figure 20A:
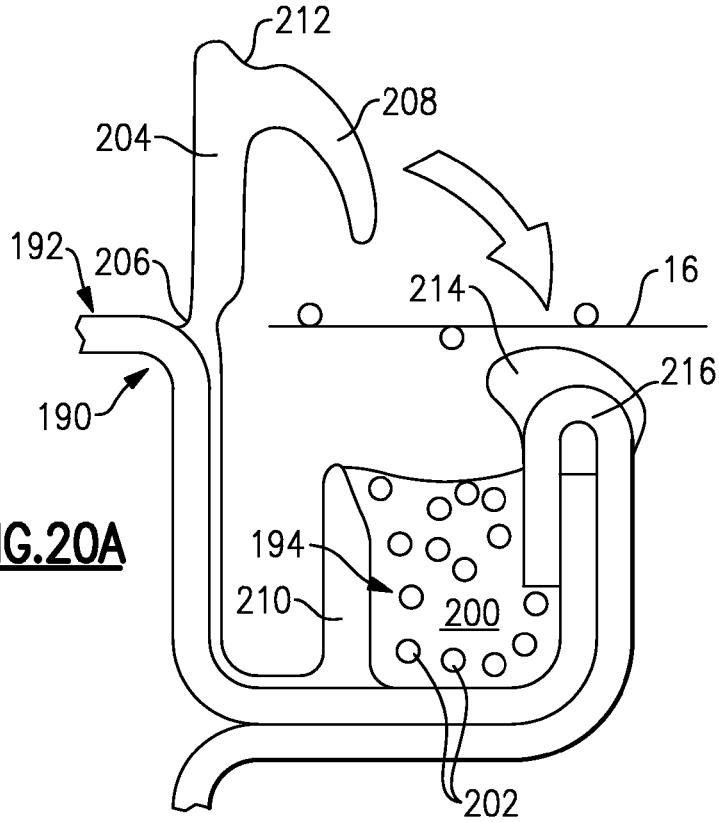

Referring to FIGS. 20A and 20B, the frame 190 includes a frame member 192 having the channel 194. The frame member 192 includes a flange portion having a flange 204 connected to the tubular portion of the frame member 192 by a living hinge 206. The flange 204 includes a hook portion 208 having a recess 212 cooperating with a protrusion 214 arranged on an end 216 of the channel 194. An intermediate wall 210 may be arranged in the channel 194 to form a cavity 200 that is filled with adhesive 202. The flange 204, intermediate wall 210, and protrusion 214 is, for example, santoprene molded onto the frame member 192. The edge of the screen 16 is arranged between the flange 204 and protrusion 214. The flange 204 is forced downward by an upwardly tapering surface 197 of the truck assembly 196. The hook portion 208 positions the edge of the screen 16 in the adhesive 202, and the screen 16 is additionally retained between the protrusion 214 and recess 212 of the hook portion 208. Applied heat from the heat source 198 actuates the adhesive 202.

Figure 21:
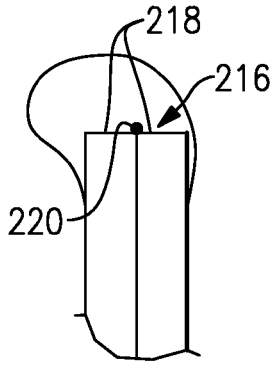
FIG. 21 is an alternative configuration of securing the edges of the blanks to form the rails and/or stiles shown in FIGS. 20A and 20B.

As an alternative configuration to the end 216, which is similar to that shown in FIG. 4A, edges 218 may be laser welded to one another using a weld bead 222 to form the end 216 shown in FIG. 21.

Although a preferred embodiment of this invention has been disclosed, a worker of ordinary skill in this art would recognize that certain modifications would come within the scope of this invention. For example, the terms "rail" and "stile" are frame members that may be used interchangeably and are intended in no way to be limiting. Accordingly, the following claims should be studied to determine the true scope and content of this invention.

What is claimed is:

1. A method of installing screens onto frames having opposing first frame members secured to opposing second frame members to provide a window screen assembly, the method comprising the steps of:

a) securing a first screen to one of the first frame members of a first frame at in a first stage;

b) transferring the first frame to a second stage and receiving a second frame at the first stage;

c) simultaneously securing the first screen to the other first frame member and a second screen to one of the first frame members of the second frame;

d) transferring the first frame to a third stage, the second frame to the second stage, and a third frame to the first stage; and e) simultaneously securing the first screen to the second frame members of the first frame.

2. The method according to claim 1, wherein steps b) and d) include adjusting for sizes of the frames.

3. The method according to claim 1, wherein step b) includes positioning the first screen relative to the first frame.

4. The method according to claim 1, wherein step c) includes moving a first truck transverse to a transfer direction of the frames.

5. The method according to claim 4, wherein step e) includes moving the first frame along the transfer direction relative to second spaced apart trucks.

6. The method according to claim 1, wherein steps a), c) and e) include securing a spline to the frame members.

7. The method according to claim 1, wherein steps a), c) and e) include deforming a portion of the frame members.

8. The method according to claim 1, wherein steps a), c) and e) include applying heat to adhesive on the frame members.

9. The method according to claim 1, wherein step e) includes simultaneously securing the second screen to the other second frame member of the second frame and the third screen to the first frame member of the third frame.

* * * * *